US005895309A

United States Patent [19]

Spector

[11] Patent Number: 5,895,309

[45] Date of Patent: Apr. 20, 1999

[54] COLLAPSIBLE HULA-HOOP

[76] Inventor: Donald Spector, 380 Mountain Rd., Union City, N.J. 07080

[21] Appl. No.: 09/020,426

[22] Filed: Feb. 9, 1998

[51] Int. Cl.[6] ..... A63H 3/06; A63H 33/02; A63G 31/12; A63B 21/22

[52] U.S. Cl. ..... 446/220; 446/236; 472/134; 482/110

[58] Field of Search ..... 446/236, 220, 446/225, 226; 472/134; 482/110

[56] References Cited

U.S. PATENT DOCUMENTS

| | | | |
|---|---|---|---|
| 3,729,860 | 5/1973 | Kargul | 446/236 |
| 3,941,384 | 3/1976 | Wopschall | 273/386 |
| 4,052,982 | 10/1977 | Ozeryansky | 601/121 |
| 4,380,885 | 4/1983 | Komataga | 446/236 |
| 5,031,908 | 7/1991 | Spector | 273/447 |
| 5,288,261 | 2/1994 | Spector | 446/267 |
| 5,338,244 | 8/1994 | Huang | 446/242 |
| 5,490,806 | 2/1996 | Spector | 446/48 |
| 5,538,454 | 7/1996 | Kessler | 446/236 |
| 5,569,134 | 10/1996 | Nordanger | 482/110 |

*Primary Examiner*—Robert A. Hafer
*Assistant Examiner*—Kurt Fernstrom
*Attorney, Agent, or Firm*—Michael Ebert

[57] ABSTRACT

A hula-hoop adapted to be whirled around the body of a player by movement of the hips. The hoop includes an inflatable annular core formed of plastic film or other flexible material enclosed within an annular fabric casing to provide a hoop of high strength which when not in use can be collapsed and folded to assume a compact state for storage and shipment.

7 Claims, 1 Drawing Sheet

COLLAPSIBLE HULA-HOOP

BACKGROUND OF INVENTION

1. Field of Invention

This invention relates generally to a hula-hoop, and more particularly to a collapsible hoop of this type formed by an inflatable core enclosed within a fabric casing.

2. Status of Prior Art

A hula is a Polynesian dance characterized by undulating hips. The hula dance may have inspired the Hula-Hoop, the trademark for a light-weight plastic ring which is whirled around the body of a player for play or exercise by movement of the hips.

A hula-hoop plastic ring has a relatively large diameter and since its form is fixed, it has certain practical drawbacks. Thus if a child wishes to take both a ball and a hula-hoop to a park or playground, he may have difficulty in doing so. Should the ball be inflatable, it can be collapsed and carried in the child's backpack. But a conventional hula-hoop cannot be collapsed, and its diameter is such that it is awkward for a child or even an adult to carry. Moreover, a hula-hoop, when sold in a toy store, takes an inordinate amount of space, for it cannot be collapsed to fit into a relatively small box.

Of prior art interest is U.S. Pat. No. 4,384,382 to Spector which discloses a pneumatic playball that has the configuration and appearance of a standard pneumatic athletic ball, such as a regulation basketball.

The Spector ball is constituted by an inner inflatable balloon confined within a fabric outer casing. The outer casing is formed by contoured segments of high strength, non-stretchable fabric material stitched together to create, when the casing is fully expanded, a play ball of the desired shape and size, such as a football or soccer ball. The balloon is a conventional thin-skin rubber balloon whose stem initially projects through a slit in the fabric casing. After inflating the balloon with air so that it conforms to the casing, the stem is then tied into a knot to seal the balloon, and the tied stem is pushed into the casing under the slit.

An unconfined rubber balloon has little strength and is easily burst. But when the same balloon is inflated within the confines of a non-stretchable fabric casing, even though the balloon, per se, is inherently weak, the casing does not permit any region of the balloon to further expand beyond its existing degree of expansion; hence the balloon will not burst even if the ball is given a hard kick.

A significant advantage of an inflatable ball of this type is that it can be collapsed to assume a highly compact state for storage and shipment. And unlike a conventional ball, it can be packaged in a small box or other container. The present invention seeks to impart the same advantage to a hula-hoop.

SUMMARY OF INVENTION

In view of the foregoing, the main object of this invention is to provide an inflatable hula-hoop that is collapsible, and when deflated can assume a compact state suitable for storage, packaging and shipment.

A significant advantage of a pneumatic hula-hoop in accordance with the invention is that it is naturally bouncy; hence should a player hurl the hula-hoop and strike another child with it, the hoop will bounce off the child and inflict no injury.

More particularly, an object of this invention is to provide pneumatic hula-hoop which when inflated is of exceptionally high strength and which when deflated and collapsed can then be folded into a compact state.

Also an object of this invention is to provide an inflatable hula-hoop having an outer fabric casing that is highly decorative to impart an attractive appearance to the hoop.

Yet another object of the invention is to provide a hula-hoop of the above type which can be mass-produced at relatively low cost.

Briefly stated, these objects are attained by a hula-hoop adapted to be whirled around the body of a player by movement of the hips. The hoop includes an inflatable annular core formed of plastic film or other flexible material enclosed within an annular fabric casing to provide a hoop high strength which when not in use can be collapsed and folded to assume a compact state for storage and shipment.

BRIEF DESCRIPTION OF DRAWING

For a better understanding of the invention, as well as further features thereof, reference is made to the detailed description thereof to be read in connection with the annexed drawings wherein.

DESCRIPTION OF INVENTION

Figure 1:
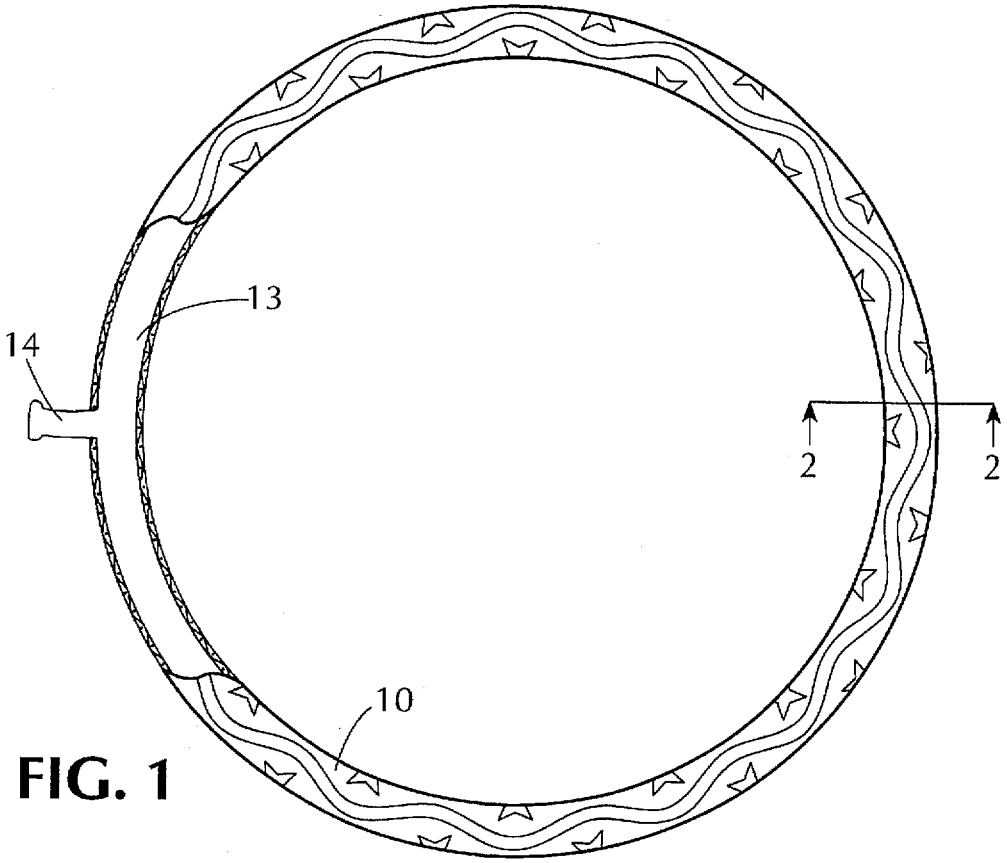
FIG. 1 is a plan view of a pneumatic hula-hoop in accordance with the invention.
Figure 2:
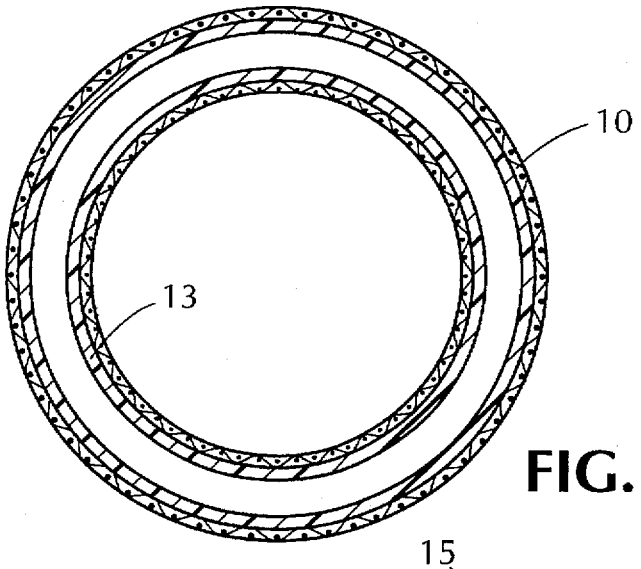
FIG. 2 is a transverse section taken in the plane indicated by line 2—2 in FIG. 1.

Referring now to FIGS. 1 and 2, it will be seen that a hula-hoop in accordance with the invention includes an annular fabric casing 10 having a circular cross section. The diameter of casing 10 is preferably about the same as that of a standard non-collapsible plastic hula-hoop, or close to that of a conventional bicycle tire having an 18 inch diameter.

Figure 3:
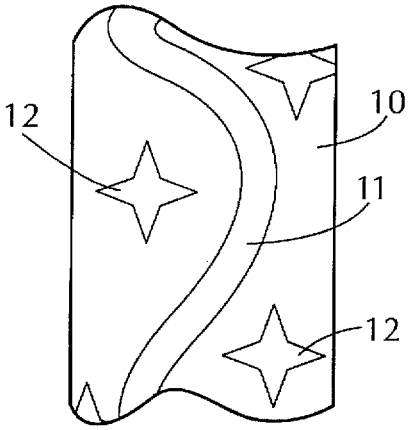
FIG. 3 is a partial view of the outer surface of the casing of the hoop.

Casing 10 is preferably fabricated of a fabric woven of natural or synthetic plastic fibers such as cotton, nylon or Dacron. The outer surface of fabric casing 10 is printed in a multi-colored decorative pattern not only to enhance the attractiveness of the hoop but also to exploit its whirling motion. Thus as shown in FIG. 3, the hoop pattern includes a continuous undulatory band 11 and star-like element of another color placed in the troughs of successive undulations. When the hoop is whirled, the undulating band creates a wave that appears to be travelling and the undulating pattern is rendered dynamic. However, the decorative pattern illustrated in FIG. 3 is merely an example of a suitable dynamic pattern.

Fabric casing 10 is sewn or otherwise sealed to conform to an enclose an inflatable inner annular core 13. Core 13 is preferably formed of synthetic plastic film material, such as PVC, Mylar polyester, polypropylene, or other plastic film material which is bi-axially oriented and therefore non-stretchable and of high strength.

Annular core 13 is provided with a stem or neck 14 which projects through a port 14 in fabric casing 10 to permit mouth inflation of the core. For this purpose, neck 14 may be provided with a removable stopper (not shown) or a one-way valve to seal the core after it has been inflated.

In practice the core, when created of non-stretchable plastic film material, may be created by a pair of superposed flat plastic washers of is material which are peripherally welded by heat an pressure at their inner and outer peripheries.

The core may be formed of an annular rubber balloon having a neck extension to inflate the balloon. Or the core may be constituted by the inner tube of a standard bicycle tire having a valved inlet.

When inner core 13 is inflated within fabric casing 10, it assumes the hula-hoop form shown in FIG. 2, And when the inner core, whether it is formed of plastic film or of a rubber skin having a thickness of 2 or 3 mils, may be relatively fragile, because the inner core is encased in a fabric outer casing, the resultant hoop is of high strength. It is capable of withstanding rough treatment, particularly when the fabric forming the outer casing is fabricated of non-stretchable material. Thus if the inner core is formed of stretchable material, and one applies pressure to the hula-hoop by sitting on one portion thereof, while this pressure seeks to compress the core in the region in which pressure is applied and to expand the core elsewhere, this expansion is resisted by the non-stretchable fabric casing which functions to maintain the configuration of the inflated core.

Figure 4:
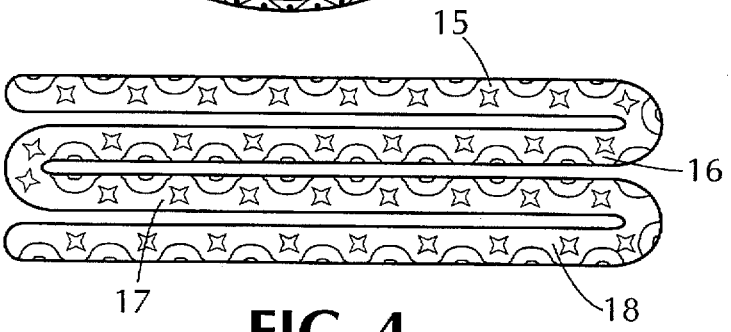
FIG. 4 shows the hula-hoop collapsed and folded to assume a compact state.

When the hula-hoop shown in FIG. 1 is not in use, it can be put into a highly compact state for storage, packaging or shipping but deflating the core to flatten the hoop which is then folded, as shown in FIG. 4, into a four layer arcuate compact formed by superposed arcs 15, 16, 17 and 18, each arc being a quarter segment of the hoop.

While there has been shown and described a preferred embodiment of a collapsible hula-hoop in accordance with the application, it will be appreciated that many changes and modifications may be made therein without, however, departing from the essential spirit thereof.

I claim:

1. A collapsible hula-hoop adapted to be whirled about the body of a player by movement of the hips, said hoop comprising:

A. an annular relatively fragile, hollow core formed of flexible material provided with a projecting neck by which the core can be inflated; and B. an annular fabric casing fully enclosing the core and having a port through which the neck projects, said casing enhancing the strength of the core when it is inflated whereby when the hoop is not in uses the core can then be deflated to collapse and flatten the hoop which can then be folded to assume a compact state suitable for storage, packaging and shipment.

2. A hoop as set forth in claim 1 in which the fabric is woven of natural or synthetic fibers.

3. A hoop as set forth in claim 2, in which the outer surface of the fabric is printed with a decorative pattern.

4. A hoop as set forth in claim 1, in which the core is formed of synthetic plastic film material.

5. A hoop as set forth in claim 4, in which the plastic film is a polyester.

6. A hoop as set forth in claim 4, in which the core is formed of a pair of superposed flat washers which are peripherally sealed together at their inner and outer peripheries.

7. A hoop as set forth in claim 1 in which the core is formed by an annular rubber balloon.

* * * * *